US006234667B1

(12) United States Patent
Longman

(10) Patent No.: US 6,234,667 B1
(45) Date of Patent: May 22, 2001

(54) WRISTWATCH INCLUDING RETAINING MEMBER, RETAINING MEMBER, AND METHOD

(76) Inventor: Scott Longman, 704 S. Crescent, Park Ridge, IL (US) 60068

( * ) Notice: Subject to any disclaimer, the term of this patent is extended or adjusted under 35 U.S.C. 154(b) by 0 days.

(21) Appl. No.: 09/028,945

(22) Filed: Feb. 24, 1998

Related U.S. Application Data

(60) Provisional application No. 60/040,357, filed on Mar. 12, 1997.

(51) Int. Cl.[7] ..... G04B 37/00
(52) U.S. Cl. ..... 368/281
(58) Field of Search ..... 368/282, 286

(56) References Cited

U.S. PATENT DOCUMENTS

| | | | | |
|---|---|---|---|---|
| D. 139,671 | | 12/1944 | Pereira . | |
| 2,511,105 | * | 6/1950 | Fenyvesev | 368/286 |
| 3,712,049 | * | 1/1973 | Luxembourg | 368/286 |
| 4,155,219 | | 5/1979 | Anderson . | |
| 4,862,436 | | 8/1989 | Harilela . | |
| 4,916,679 | | 4/1990 | Agnello . | |
| 5,272,682 | | 12/1993 | Falcone . | |
| 5,332,135 | | 7/1994 | Fletcher . | |
| 5,812,500 | * | 9/1998 | Webb, Jr. | 368/282 |
| 5,838,642 | * | 11/1998 | Tully | 368/282 |

* cited by examiner

*Primary Examiner*—Bernard Roskoski
(74) *Attorney, Agent, or Firm*—Leydig, Voit & Mayer, Ltd.

(57) ABSTRACT

The invention provides a wristwatch including a watch piece, a watch band having first and second portions, and one or more retaining members connecting the first and second portions of the watch band to each other and/or to the watch piece. The retaining member or members comprise a strap of flexible material. In one embodiment of the invention, a retaining member has first and second portions, the first portion connected to the first watch band portion and the second portion connected to the second watch band portion. In another embodiment of the invention, the wristwatch is provided with at least two retaining members. One of the retaining members has a first portion connected to the first watch band portion, and a second portion connected to the rear face of the watch piece. The second retaining member has a first portion connected to the rear face of the watch piece and a second portion connected to the second watch band portion. A retaining member and methods for providing secondary connection of portions of to a watch band to each other and/or to the watch piece also are provided.

10 Claims, 2 Drawing Sheets

WRISTWATCH INCLUDING RETAINING MEMBER, RETAINING MEMBER, AND METHOD

This Application claims priority to Ser. No. 60/040,357 filed Mar. 12, 1997. The entire contents of the foregoing provisional patent application are hereby incorporated by reference.

TECHNICAL FIELD OF THE INVENTION

The present invention is in the field of wristwatches, and specifically the field of wristwatches having a watch piece and a watch band that is supported on the watch piece with one or more pins.

BACKGROUND OF THE INVENTION

Wristwatches commonly comprise a watch piece and a watch band to allow the watch piece to be carried on the wrist of a wearer. In many cases, the watch band is supported on the watch piece by a pair of pins, which are themselves each supported on the housing of the watch piece between pairs of collinear facing recesses disposed on bearing portions of the housing. The pins are readily prone to becoming broken or dislodged from their supporting recesses, especially when the wearer of the wristwatch is engaged in an activity involving rapid movement of the arms and wrists, or when the wristwatch contacts a hard surface. If even one of the two pins breaks, the watch will fall off of the wearer's wrist, potentially leading to loss of the wristwatch.

It is a general object of the invention to provide a method for providing secondary connection of portions of the watch band of a wristwatch to each other and/or to the watch piece, such that, if one of the pins becomes broken or dislodged, portions of the watch band will remain connected to each other or to the watch piece. It is another general object of the invention to provide a wristwatch that will remain on the wearer's wrist if one of the pins becomes broken or dislodged.

SUMMARY OF THE INVENTION

In accordance with the invention, a wristwatch includes one or more retaining members connecting first and second portions of the watch band to each other and/or to the watch piece. The retaining member or members comprise a strap of flexible material. In one embodiment of the invention, a retaining member has first and second portions, the first portion connected to the first watch band portion and the second portion connected to the second watch band portion. In another embodiment of the invention, the wristwatch is provided with at least two retaining members. One of the retaining members has a first portion connected to the first watch band portion, and a second portion connected to the rear face of the watch piece. The second retaining member has a first portion connected to the rear face of the watch piece and a second portion connected to the second watch band portion.

The scope of the invention encompasses a wristwatch, a retaining member for a wristwatch, and methods for providing secondary connection of portions of the watch band of a wristwatch to each other and/or to the watch piece. Other features and objects of the invention will be apparent from the description and appended claims.

DETAILED DESCRIPTION OF THE INVENTION

Figure 1:
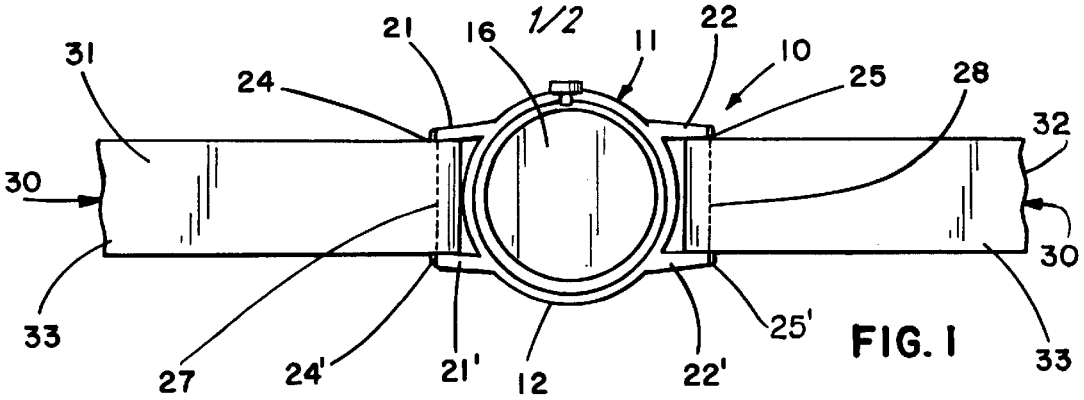
FIG. 1 is a rear plan view of a wristwatch in accordance with the invention, without a retaining member.
Figure 6:
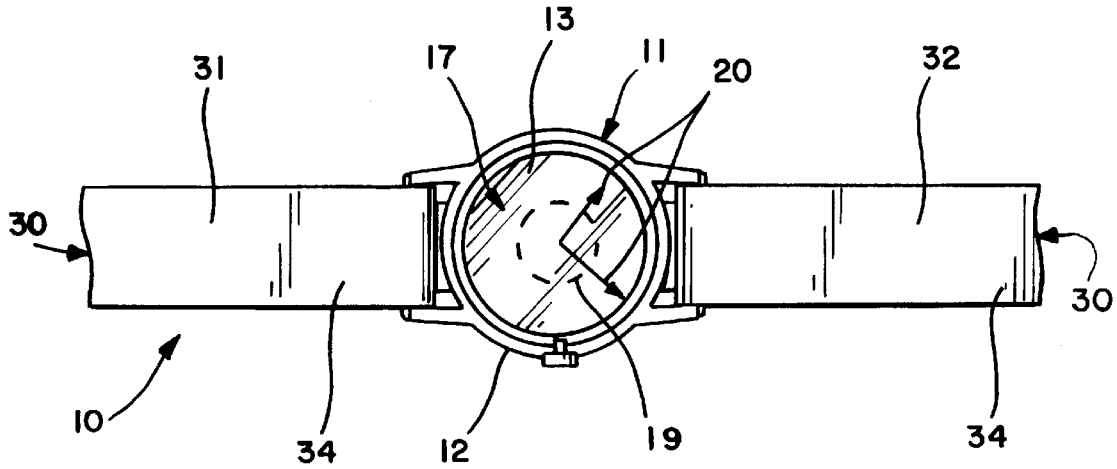
FIG. 6 is a front plan view of a wristwatch in accordance with the invention.

With reference to FIGS. 1 and 6, the wristwatch 10 of the invention comprises a watch piece 11, which comprises a housing 12 having a front face 13 (shown in FIG. 6) and a rear face 16 (shown in FIG. 1). The front face 13 normally faces away from the wrist of the wearer when the watch is worn on the wrist of the wearer, and the rear face 16 normally faces towards the wrist of the wearer. A compartment 17 is defined by the housing 11, which compartment holds a timepiece 19 (shown in FIG. 6). Time indication means 20 cooperate with the timepiece 19 and are displayed at the front face 13 of the watch. It is not intended to limit the invention to specific any timepiece or time indication means. Thus, for example, the timepiece may be a spring-driven timepiece, or may be battery-operated. The time indication means may comprise, for example, analog watch hands or a digital display (not shown).

In the illustrated embodiment, the housing 11 includes bearing portions 21, 21', 22, 22'. Portions 21, 21' include a first pair of collinear, facing recesses 24, 24', and portions 22, 22' include a second pair of collinear, facing recesses 25, 25'. The first and second pairs of recesses 24, 24' support a first pin 27, and the second pair of recesses 25, 25' support a second pin 28.

The wristwatch further includes a watch band 30 having first and second portions 31, 32. It is not intended to limit the watch band to any specific watch band, and the watch band may comprise, for example, a vinyl or leather band, a band of elastomeric material, a metallic chain or linkage, or the like. The first and second portions may be separate segments, such as, for example, when the watch band is a leather band having first and second portions connected at a buckle (not shown). Alternatively, the band may be a continuous single band or loop, in which the first and second portions connect are continuous. In either case, the first and second portions connect to support the watch piece on the wrist of a wearer. As shown in the Figures, the first portion 31 of the band 30 is supported by the first pin 27, and the second portion 32 of the band 30 is supported by the second pin 28. Each portion of the watch band has a front surface 34 (shown in FIG. 6) normally facing away from the wrist of a wearer and a rear surface 33 (shown in FIG. 1) normally facing towards the wrist of the wearer.

Figure 2:
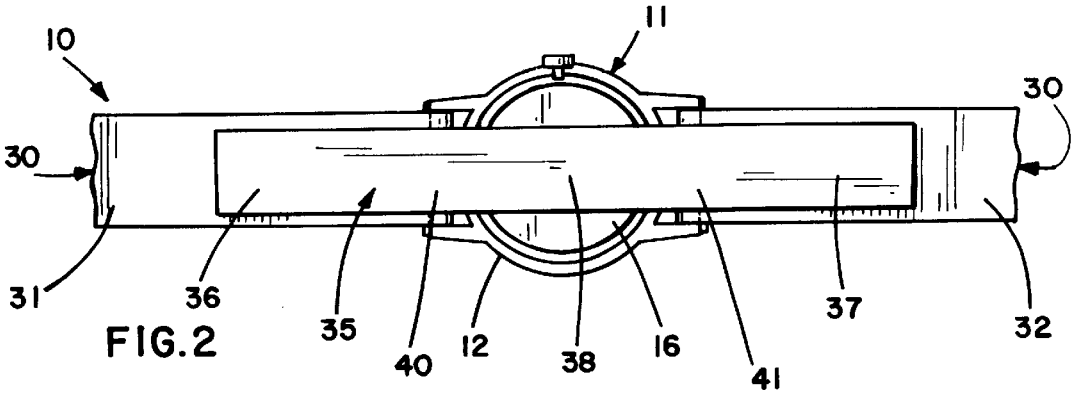
FIG. 2 is a rear plan view of a wristwatch in accordance with the invention, having a retaining member in accordance with one embodiment of the invention.

In accordance with one embodiment of the invention, as illustrated in FIG. 2, the wristwatch 10 includes a retaining member 35 connecting the first portion 31 of the watch band 30 to the second portion 32 of the watch band. The retaining member 35 comprises a strap of flexible material. Any suitable material may be used in conjunction with the invention, but the preferred materials are moleskin, neoprene rubber, and the like. When the retaining member is selected from among these or similar materials, the retaining member will not chafe the skin, and indeed may prevent the metallic or plastic rear face of the watch piece from chafing the skin.

In accordance with this embodiment of the invention, the retaining member 35 has a first portion 36 connected to the first portion 31 of the watch band 30, and a second portion 37 connected to the second portion 32 of the watch band 30. Optionally, a third portion 38 of the retaining member 35 is connected to the rear face 16 of the watch piece 11. The retaining member may be connected to the watch band and optionally to the watch piece by any suitable means, such as, for example, hook-and-loop fasteners or, preferably, by an adhesive. Those of ordinary skill in the art will be familiar with adhesives of the type suitable for use in conjunction with the present invention. The adhesive may be applied in any suitable manner. For example, one surface of the retaining member may be coated or partially coated with an adhesive. Preferably, the retaining member does not have adhesive at intermediate regions 40, 41, so that the exposed surface of the retaining member will not adhere to skin or dirt.

Figure 3:
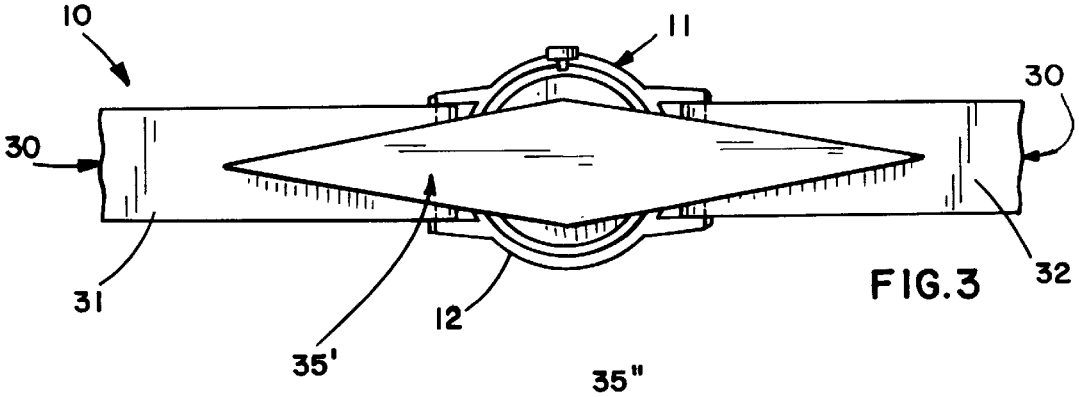
FIG. 3 is a rear plan view of a wristwatch in accordance with the invention, having a retaining member in accordance with another embodiment of the invention.
Figure 4:
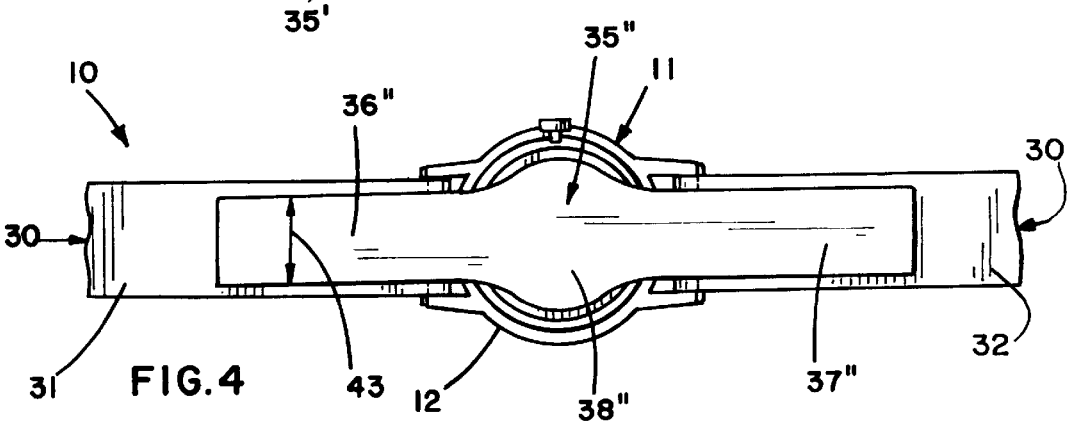
FIG. 4 is a rear plan view of a wristwatch in accordance with the invention, having a retaining member in accordance with another embodiment of the invention.

FIG. 2 illustrates a retaining member having a rectilinear shape. The retaining member may have any number of other shapes, as illustrated, for example, in FIG. 3 (showing a retaining member 35' having a tapered diamond shape). In accordance with the preferred embodiment of the invention, the retaining member is shaped as illustrated in FIG. 4. That is, the first portion 36" of the retaining member 35" has a contour corresponding or substantially corresponding to the contour of the first watch band portion 31; the second portion 37" of the retaining member 35" has a contour corresponding or substantially corresponding to the contour of the second watch band portion 32; and the third portion 38" of the retaining member 35" has a contour corresponding or substantially corresponding to the contour of the rear face 16 of the watch piece 11. To correspond in the region of the watch band, it is sufficient, for example, that the width 43 of the retaining member 35" approximate the width of the first watch band portion 31. Of course, the shape and dimensions of the retaining member will be determined by those of the watch piece and the watch band.

Figure 5:
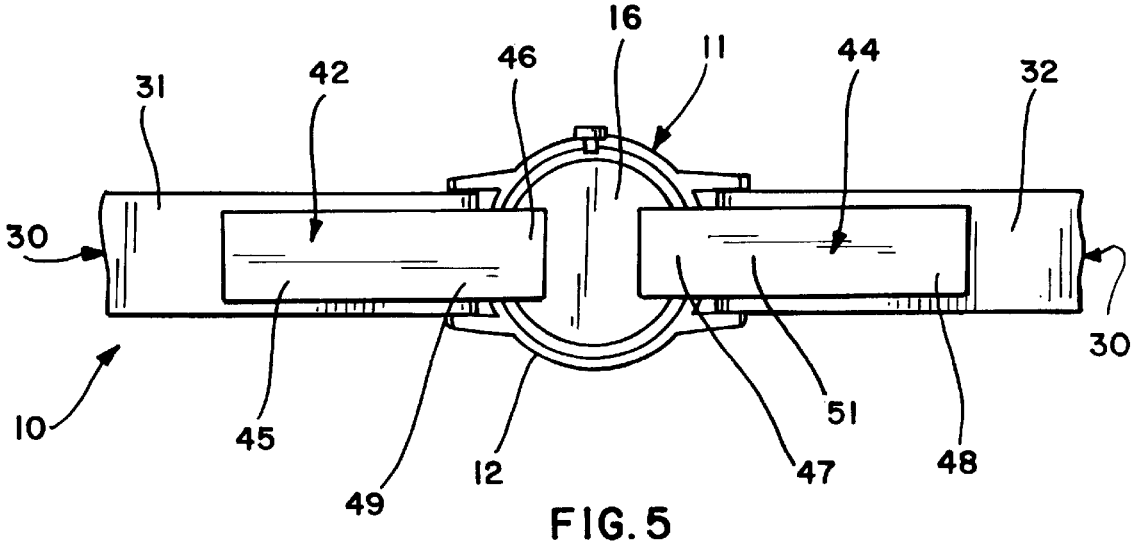
FIG. 5 is a rear plan view of a wristwatch in accordance with the invention, having two retaining members in accordance with another embodiment of the invention.

In accordance with another embodiment of the invention, the wristwatch includes two retaining members 42, 44, as shown in FIG. 5. Each retaining member is substantially as described, except that the first retaining member 42 has a first portion 45 connected to the first watch band portion 31 and a second portion 46 connected to the rear face 16 of the watch piece 11. The second retaining member 44 has a first portion 47 connected to the rear face 16 of the watch piece 11 and a second portion 48 connected to the second watch band portion 32. If adhesive is used to connect the retaining members 42, 44 to the watch piece and watch band, it is preferred that no adhesive be used in intermediate regions 49, 51.

In accordance with the preferred embodiment of the invention, the retaining member is not visible or is only slightly visible from the front of the watch, as shown in FIG. 6, or when the watch is worn. Preferably, all or substantially all of the front surface of the watch band is exposed, i.e., not covered wholly or even partially by the retaining member. Thus, the watch and retaining member of the invention may be used, for example, in conjunction with fashionable "dress" watches. If, for example, the watch band is decorated, the retaining member will not be visible, but will remain discreetly worn.

The invention also encompasses a retaining member as described herein, and a method for providing secondary connection of the watch piece to the watch band. The method of the invention includes, in one embodiment, the steps of providing a wristwatch as described herein, including a watch band having first and second portions; providing a retaining member having first and second portions; adhesively securing the first portion of the retaining member to the first watch band portion; and adhesively securing the second portion of the retaining member to the second watch band portion. In another embodiment, the method comprises the steps of providing a wristwatch as described herein, including a watch band having first and second portions; providing first and second retaining members, each having first and second portions; adhesively securing the first portion of the first retaining member to the first watch band portion and the second portion of the first retaining member to the rear face of the watch piece; and adhesively securing the first portion of the second retaining member to the rear face of the watch piece and the second portion of the first retaining member to the second watch band portion.

Thus, it is seen that the foregoing general object has been satisfied. A method for providing secondary connection of portions of a watch band to each other and/or to the watch piece of a wristwatch is provided. A wristwatch having a retaining member in accordance with the invention will remain fastened to the wrist of the wearer, even if one or possibly both of the watch pins become broken or dislodged.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A wristwatch comprising, in combination, a watch piece, said watch piece comprising a housing defining a compartment, a timepiece disposed within said compartment, said housing having opposing front and rear faces, said front face displaying time indication means cooperating with said timepiece, said front face normally facing away from the wrist of a wearer and said rear face normally facing towards the wrist of a wearer when said watch is worn on the wrists of the wearer, said housing having first and second pairs of bearing portions, said first pair of bearing portions supporting a first pin and said second pair of bearing portions supporting a second pin;

a watch band comprising first and second watch band portions, said first watch band portion supported by said first pin and said second watch band portion supported by said second pin, said first and second watch band portions connecting to support said wristwatch on the wrist of a wearer, each of said first and second watch band portions having a front surface normally facing away from the wrist of a wearer and a rear surface normally facing towards the wrist of a wearer; and a retaining member comprising a strap of flexible material, said retaining member having a first portion connected to said rear surface of said first watch band portion and a second portion connected to said rear surface of said second watch band portion.

2. A wristwatch according to claim 1, wherein said retaining member further includes a third portion connected to said rear face of said watch piece.

3. A wristwatch according to claim 1, said front surfaces of said first and second watch band portions being exposed.

4. A wristwatch according to claim 1, said retaining member comprising a material selected from the group consisting of moleskin and neoprene rubber.

5. A wristwatch according to claim 2, said first portion of said retaining member having a contour substantially corresponding to the contour of said first watch band portion, said second portion of said retaining member having a contour substantially corresponding to the contour of said second watch band portion, said third portion of said retaining member having a contour substantially corresponding to the contour of said rear face of said watch piece.

6. A wristwatch according to claim 5, said portions of said retaining member connected to said watch band and said watch piece with an adhesive.

7. For a wristwatch having a watch piece and a watch band, the watch piece comprising a housing defining a compartment, a timepiece disposed within said compartment, said housing having opposing front and rear faces, said front face displaying time indication means cooperating with said timepiece, said front face normally facing away from the wrist of a wearer and said rear face normally facing towards the wrist of a wearer, said housing having first and second pairs of bearing portions, said first pair of bearing portions supporting a first pin and said second pair of bearing portions supporting a second pin; said watch band comprising first and second watch band portions, said first watch band portion supported by said first pin and said second watch band portion supported by said second pin, said first and second watch band portions connecting to support said wristwatch on the wrist of a wearer, each of said first and second watch band portions having a front surface normally facing away from the wrist of a wearer and a rear surface normally facing towards the wrist of a wearer, a retaining member comprising:

a strap of flexible material having a first portion having a contour substantially corresponding to the contour of said first watch band portion, a second portion having a contour substantially corresponding to the contour of said second watch band portion, and a third portion having a contour substantially corresponding to the contour of said rear face of said watch piece, at least said first and second portions of said retaining member having an adhesive backing.

8. A wristwatch comprising, in combination, a watch piece, said watch piece comprising a housing defining a compartment, a timepiece disposed within said compartment, said housing having opposing front and rear faces, said front face displaying time indication means cooperating with said timepiece, said front face normally facing away from the wrist of a wearer and said rear face normally facing towards the wrist of a wearer when said watch is worn on the wrist of the wearer, said housing having first and second pairs of bearing portions, said first pair of bearing portions supporting a first pin and said second pair of bearing portions supporting a second pin;

a watch band comprising first and second watch band portions, said first watch band portion supported by said first pin and said second watch band portion supported by said second pin, said first and second watch band portions connecting to support said wristwatch on the wrist of a wearer, each of said first and second watch band portions having a front surface normally facing away from the wrist of a wearer and a rear surface normally facing towards the wrist of a wearer;

a fist retaining member comprising a strap of flexible material, said retaining member having a first portion connected to said rear surface of said first watch band portion and a second portion connected to said rear surface of said watch piece; and a second retaining member comprising a strap of flexible material, said retaining member having a first portion connected to said rear surface of said watch piece and a second portion connected to said rear surface of said second watch band portion.

9. For a wristwatch including a watch piece and a watch band, said watch band having first and second portions supported at said watch piece, a method for providing secondary connection of said first portion of said watch band to said portion of said watch band, the method comprising the steps of:

providing a wristwatch, said wristwatch comprising a watch piece and a watch band, said watch piece comprising a housing defining a compartment, a timepiece disposed within said compartment, said housing having opposing front and rear faces, said front face displaying time indication means cooperating with said timepiece, said front face normally facing away from the wrist of a wearer and said rear face normally facing towards the wrist of a wearer, said housing having first and second pairs of bearing portions, said first pair of bearing portions supporting a first pin and said second pair of bearing portions supporting a second pin;

said watch band comprising first and second watch band portions, said first watch band portion supported by said first pin and said second watch band portion supported by said second pin, said first and second watch band portions connecting to support said wristwatch on the wrist of a wearer, each of said first and second watch band portions having a front surface normally facing away from the wrist of a wearer and a rear surface normally facing towards the wrist of a wearer;

providing a retaining member, said retaining member comprising a strap of flexible material including first and second portions;

adhesively securing said first portion to said first watch band portion; and adhesively securing said second portion to said second watch band portion.

10. For a wristwatch including a watch piece and a watch band, a method for providing secondary connection of said watch piece to said watch band, the method comprising the steps of:

providing a wristwatch, said wristwatch comprising a watch piece and a watch band, said watch piece comprising a housing defining a compartment, a timepiece disposed within said compartment, said housing having opposing front and rear faces, said front face displaying time indication means cooperating with said timepiece, said front face normally facing away from the wrist of a wearer and said rear face normally facing towards the wrist of a wearer, said housing having first and second pairs of bearing portions, said first pair of bearing portions supporting a first pin and said second pair of bearing portions supporting a second pin;

said watch band comprising first and second watch band portions, said first watch band portion supported by said first pin and said second watch band portion supported by said second pin, said first and second watch band portions connecting to support said wristwatch on the wrist of a wearer, each of said first and second watch band portions having a front surface normally facing away from the wrist of a wearer and a rear surface normally facing towards the wrist of a wearer;

providing first and second retaining members, each of said retaining member comprising a strap of flexible material and including first and second portions;

adhesively securing said first portion of said first retaining member to said first watch band portion and said second portion of said first retaining member to said rear face of said watch piece; and adhesively securing said first portion of said second retaining member to said rear face of said watch piece and said second portion of said second retaining member to said second watch band portion.

* * * * *